US006655059B2

(12) United States Patent
Perry et al.

(10) Patent No.: US 6,655,059 B2
(45) Date of Patent: Dec. 2, 2003

(54) HAND-HELD ROLLER READER DEVICE

(76) Inventors: Scott G. Perry, P.O. Box 308, Moody, ME (US) 04054; James S. Whittney, P.O. Box 356, N. Berwick, ME (US) 03906

( * ) Notice: Subject to any disclaimer, the term of this patent is extended or adjusted under 35 U.S.C. 154(b) by 80 days.

(21) Appl. No.: 10/094,854

(22) Filed: Mar. 12, 2002

(65) Prior Publication Data

US 2003/0172564 A1 Sep. 18, 2003

(51) Int. Cl.[7] ..... G09F 11/02; G09F 11/08
(52) U.S. Cl. ..... 40/518; 40/471
(58) Field of Search ..... 40/518–521, 471, 40/522, 523, 904

(56) References Cited

U.S. PATENT DOCUMENTS 2,752,705 A * 7/1956 Eberson ..... 40/518
3,195,242 A * 7/1965 Ward et al. ..... 434/342

* cited by examiner

*Primary Examiner*—Cassandra H. Davis

(57) ABSTRACT

A slotted cylinder contains a pair of first and second rollers extending within the cylinder between opposing gears carried by associated sidepieces at the opposing ends of the cylinder. A scroll of reading paper connects between the rollers such that rotating a knob at one-end transfers the reading paper in a first direction between the rollers. Rotating a knob at the opposite end transfers the reading paper in the opposite direction. The reading paper is viewed external to the cylinder through the cylinder slot

18 Claims, 5 Drawing Sheets

HAND-HELD ROLLER READER DEVICE

BACKGROUND OF THE INVENTION invention relates to a simple hand-held reading device that can be installed in a lavatory, restroom, waiting room and the like.

U.S. Pat. NO. 5,068,988 entitled "Document Supporting Apparatus", describes an expansive display in the form of a large-sized arrangement of a pair of rollers whereby one of the rollers contains a roll of information in the form of text and pictures, which roll transfers to the other roller allowing the information to be viewed along a continuous plane.

U.S. Pat. No. 5,638,625 entitled"Information Board" discloses a display arrangement of several rollers, each supporting a separate roll of information arranged within a rectangular container having corresponding viewing slots. The rolls are individually unrolled to allow the information to be viewed through viewing slots from a position exterior to the container.

The size and arrangement of the prior reading devices makes it difficult for a single user to hold the apparatus in one hand while transferring the information from one roll to the other by the use of the other hand especially when the reader is in a sitting position without the presence of a desk or table for support.

It would be ergonomically advantageous to have a single hand-held roller device whereby a pair of rollers within a small-sized enclosure can be manually manipulated to advance a roll of reading paper.

One purpose of the invention is to provide a simple, hand-held "reader-roller" enclosure whereby a user can support the device in one hand while transfer-winding the reading paper from one roll to another without changing hands. Winding in a clockwise direction with the top right knob advances the reading paper in a first direction while winding the reading paper in a clockwise direction with the bottom left knob transfers the reading paper in an opposite direction without having to transfer the enclosure from one hand to the other.

SUMMARY OF THE INVENTION

A slotted plastic or metallic cylinder contains a pair of first and second rollers extending within the cylinder between opposing gears carried by associated covers at the opposing ends of the cylinder. A roll of reading paper connects between the rollers such that rotating a driver wheel at one end rotates the associated gear and first roller to transfer the reading paper in a first direction between the rollers. Rotating a driver wheel at the opposite end rotates the associated gear and second roller to transfer the reading paper in a second direction between the rollers, opposite from the first direction. The reading paper is viewed external to the cylinder through the cylinder slot.

DESCRIPTION OF THE PREFERRED EMBODIMENT

Figure 1A:
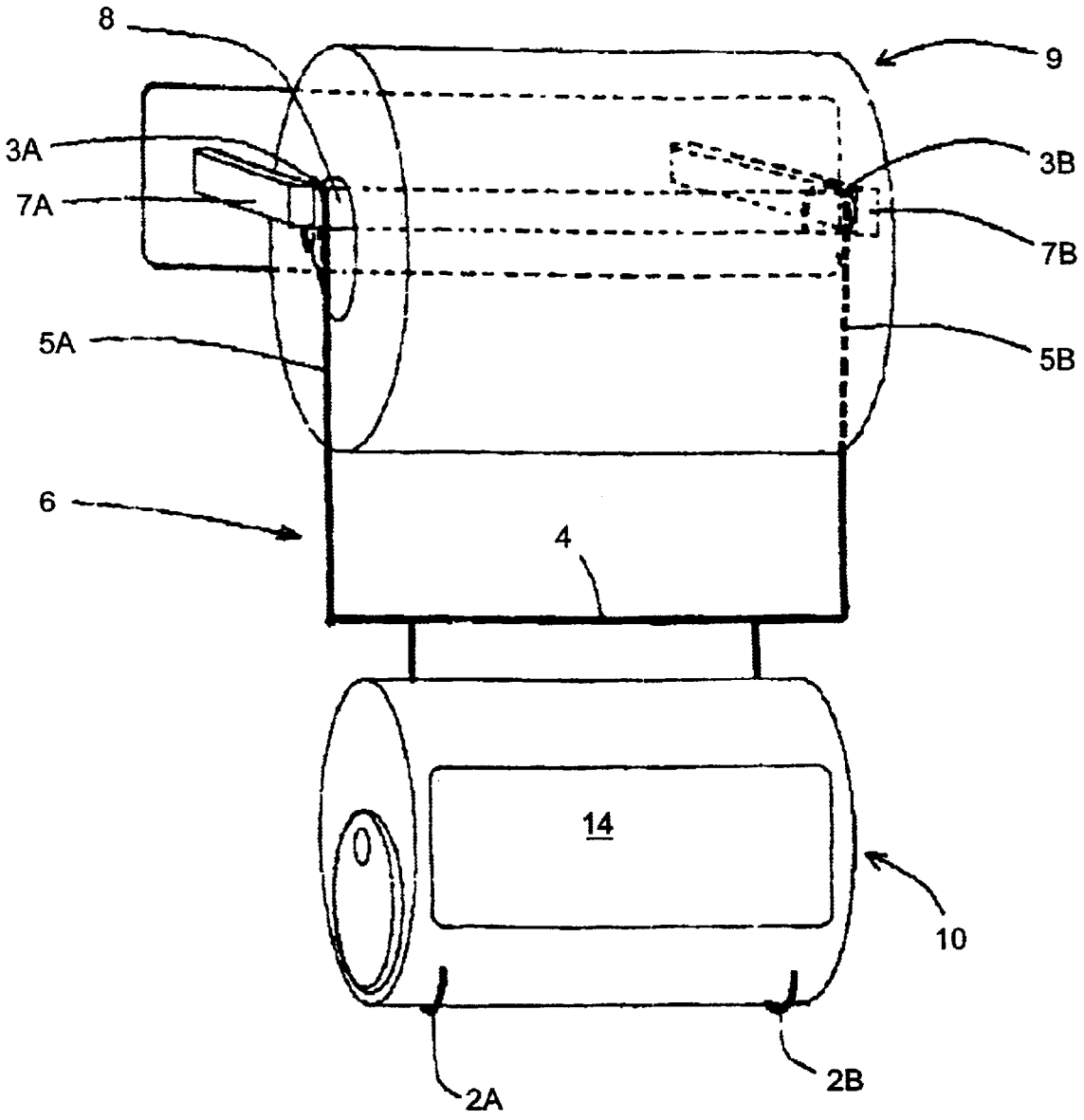
FIG. 1A is a top perspective view of the roller reader according to the invention shown attached to a toilet paper holder.

One embodiment of the reader roller 10 including a viewing window 14 according to the invention, is shown in FIG. 1A adjacent a roll of toilet paper 9 that is held by means of rod 8 that extends between a pair of support arms 7A, 7B. The reader roller is supported and held in position by means of an angulated strap 6 that includes a pair of off-set arms 5A, 5B that terminate at one end in a pair of larger support hooks 2A, 2B that hold the roller reader 10 and a pair of smaller support hooks 3A, 3B, at the opposite end that engage the rod 8. The offset arms 5A, 5B are supported by means of a cross-brace, as indicated at 4.

Figure 1B:
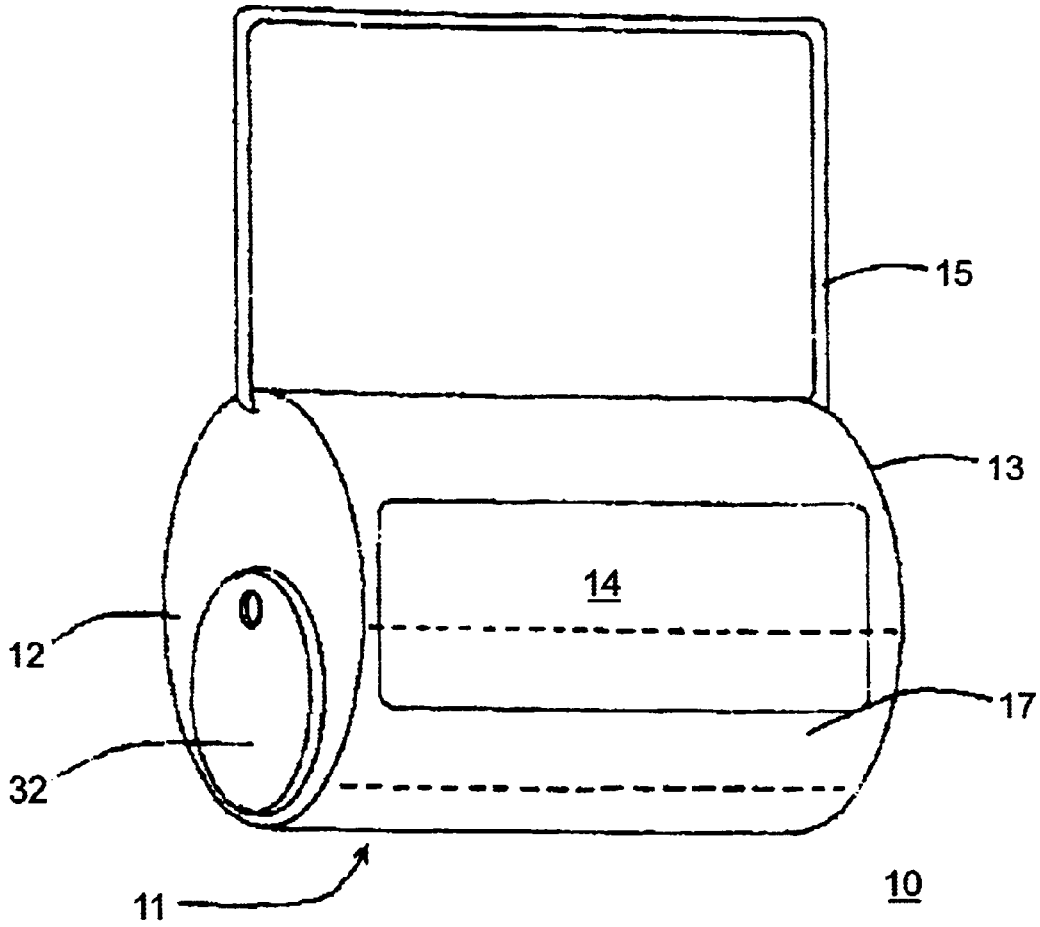
FIG. 1B is a top perspective view of the roller reader of FIG. 1 including a flexible strap for versatile location thereof.

A further embodiment of the reader roller 10, is shown in FIG, 1B to comprise a hollow metal or plastic cylinder 11 having opposing side pieces 12, 13 containing a paper scroll 17 of written material which is visible by means of the viewing window 14 of a magnifying plastic lens arrangement. The reader roller is positioned near a seating arrangement by means of the strap 15. The paper scroll is moved clockwise, as viewed in FIG. 1B, by rotation of the second roller drive knob 32, which will be described below in greater detail. The first roller drive knob 25 (FIG. 2) is located on the opposite side of the cylinder 11.

Figure 2:
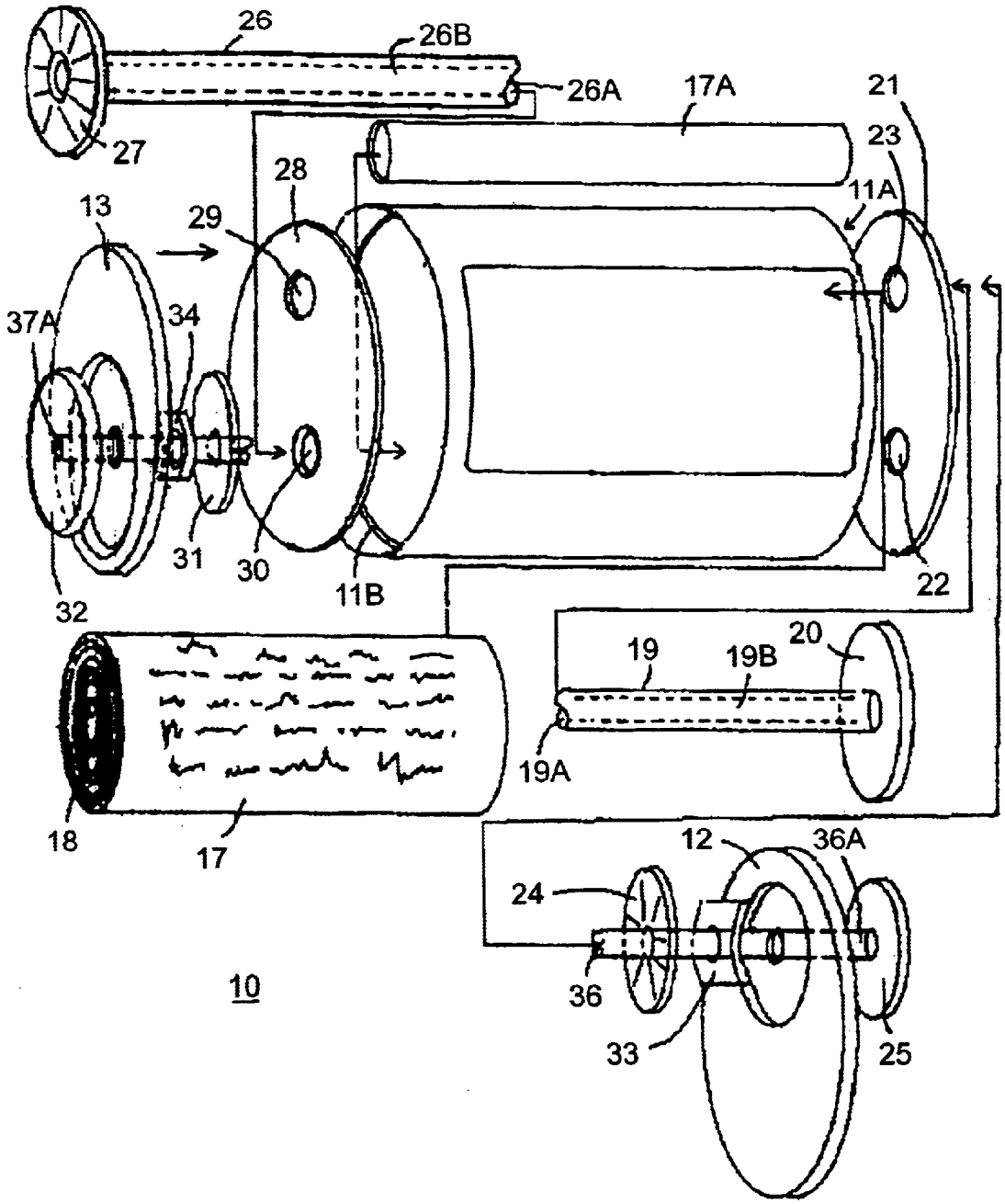
FIG. 2 is an exploded top perspective view of the roller reader of FIG. 1 prior to assembly.

The components of the reader roller 10 are best seen by now referring to FIG. 2 wherein the paper scroll 17 containing the reading information is arranged on a hollow paper or plastic roll 18. The scroll 17 is positioned on a first roller 19 by placement over the end 19A. The first roller 19 terminates at a plurality of first gear teeth 20 at the opposite end, and includes a hollow channel extending there thru as indicated at 19B. The first roller 19 and paper scroll 17 are inserted within the cylinder 11 and the first inner cover 21 is positioned on the end 11A of the cylinder such that the roller 19 extend thru the opening 23 in the inner cover 21. The opening 22 is positioned to receive the end 26A of the second roller 26 which is next positioned within the cylinder 11 via the opposite end 11B. The second roller 26 is similar to the first roller 19 and includes a plurality of second gear teeth 27 opposite the end 26A and a hollow channel 26B extending there thru. The second roller 26 is inserted within the cylinder 11 and the second inner cover 28 is positioned on the end 11B of the cylinder such that the roller 26 extend thru the opening 30 in the inner cover 28. The opening 29 is positioned to receive the end 19A of the first roller 19. The sidepiece 12 is next positioned on the end 11A of the cylinder 11 over the inner cover 21 such that the first post 36 extending from the first gear driver 24 extends within the opening 23 on the inner cover 21 within the end of the hollow channel 19B to position the first gear driver 24 in engagement with the gear teeth 20 on the first roller 19. The spring clip 33 extends from the inner surface of the sidepiece 12 to hold the gear 24 in engagement with the first gear teeth 20 to allow the paper on the paper scroll 17 to transfer from the second roller 26 to the first roller 19 by rotation of the roller drive knob 25 on the outer surface of the first sidepiece 12 attached to the post 36A extending thru the sidepiece 12 and inner cover 21 in the manner to be describe below in greater detail. The sidepiece 13 is next positioned on the end 11B of the cylinder 11 such that the second post 37 extending from the second gear driver 31 extends thru the opening 29 on the second inner cover 28 within the end of the hollow channel 26B to position the second gear driver 31 in engagement with the gear teeth 27 on the second roller 26 to complete the assembly. The spring clip 34 extends from the inner surface of the second sidepiece 13 to hold the gear 31 in engagement with the second gear teeth 27 to allow the paper on the paper scroll to transfer from the first roller 19 to the second roller 26 by operation of the drive knob 32 on the outer surface of the second sidepiece 13 attached to the post 37A extending thru the sidepiece 13 and inner cover 28 when the paper 17' on the paper scroll 17 transfers from the first roller 19 to the second roller 26 by operation of the roller drive knob 32 on the outer surface of the second sidepiece 13 attached to the post 37 extending thru the sidepiece 12 and inner cover 28.

Figure 3:
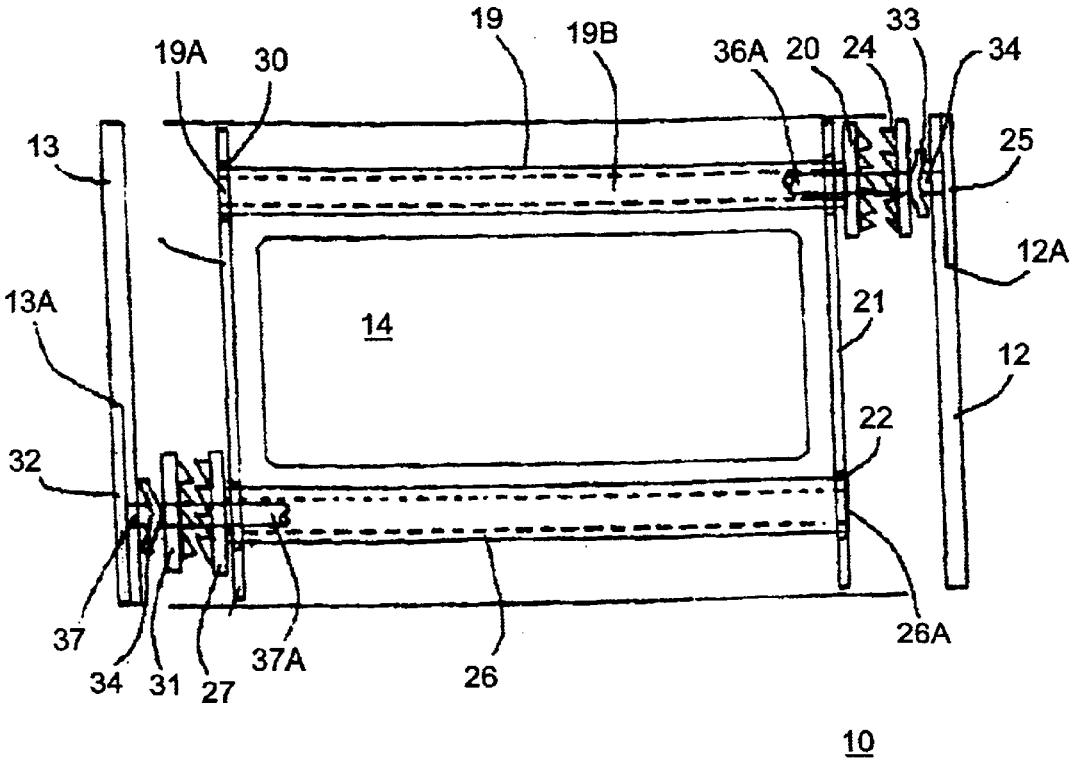
FIG. 3 is an enlarged top view of the roller reader of FIG. 1 with the outer cylinder removed to depict the inner rollers.

The positional arrangement of the first and second rollers 19, 26 relative to the viewing window 14 on the reader roller 10 and first and second sidepieces 12, 13 is shown in FIG. 3. The ends 19A, 26A of the rollers 19, 26 extend thru corresponding openings 22, 30 within the first and second inner covers 21, 28 with the ends 36A, 37A of posts 36, 37 within the associated channels 19B, 26B for positioning the gear drivers 24, 31 in association with the gear teeth 20, 27. The spring clips 33, 34 hold the gear drivers 24, 31 in engagement with the gear teeth until and unless either of the drive knobs 25 or 32 within the associated recesses 12A, 13A formed within the sidepieces 12, 13 are rotated in the counter-clockwise direction to thereby overcome the retention force of the associated spring clips 33, 34 and move the associated gear drivers out of operative engagement with the associated gear teeth. This occurs due to the "one-way" configuration of the gear teeth 20, 27 with the associated gear drivers 24, 31 which allows rotation only in the clockwise direction to prevent "paper roll slack", as defined herein as the loosening of the paper 17' (FIG. 5) between the rollers 19, 26, rather than the transfer of the paper from one roller to the other roller. It is noted that only one of the gear drivers and gear teeth can be engaged at one time to allow rotation of the associated roller. In the arrangement depicted herein, rotation of drive knob 32 in the indicated clockwise direction rotates the associated roller 26 to advance the paper 17' associated with the paper scroll 17 (FIG. 5) onto roll 26 while the gear driver 24 and gear teeth 20 remain in contact due to the "one-way" gear configuration described earlier. . Rotation of drive knob 25 in the indicated clockwise direction rotates the associated roller 19 to advance the continuous paper roll associated with the paper scroll 17 onto roller 19 while the gear driver 31 and gear teeth 27 remain in contact to thereby allow transfer of the paper roll in both directions under the viewing window 14.

Figure 4A:
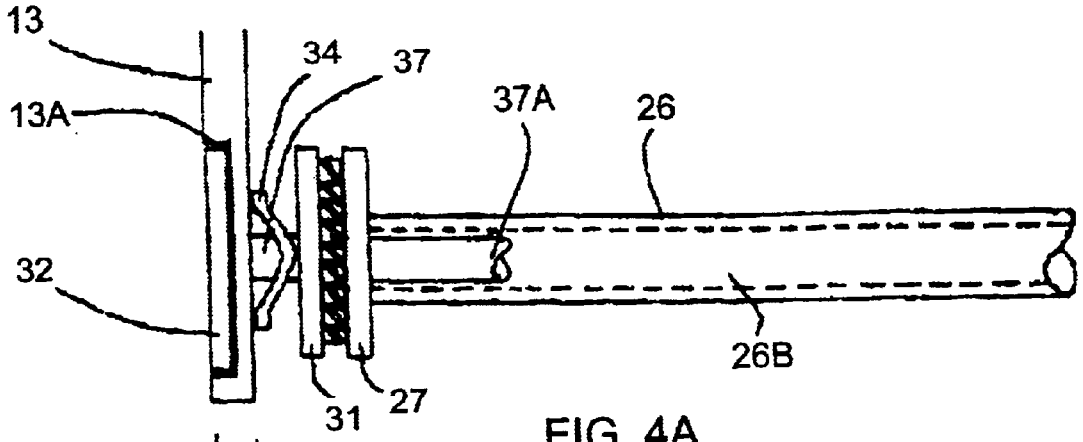
FIGS. 4A and 4B are top views of one of the rollers of FIG. 3 in a clockwise and counterclockwise condition of rotation.
Figure 4B:
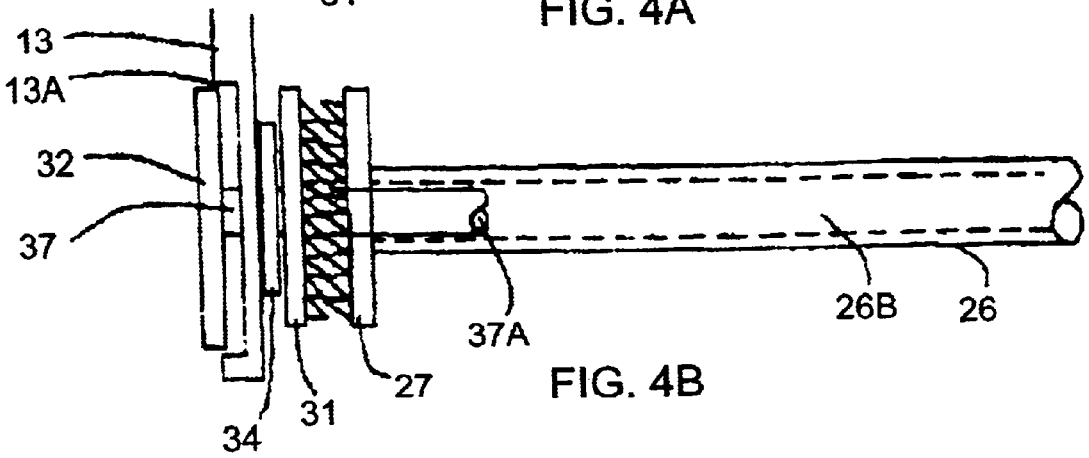

The function of the spring clip 34 associated with the roller 26 and drive knob 32 is depicted in FIG. 4B. With the drive knob 32 on post 37 within the recess 13A within sidepiece 13, as shown in FIG. 4A, the spring clip 34 urges the gear driver 31 into operative engagement with the gear teeth 27 whereby rotation of the drive knob 32 in the clockwise direction, as indicated, rotates the roller 26 in the clockwise direction. Moving the drive knob 32 in the counter-clockwise direction urges the drive knob out of the recess 13A on the sidepiece 13 as shown in FIG. 4B to overcome the tension of the spring clip 34 and cause the gear driver 31 to move out of engagement with the gear teeth 27 by means of the "one way" gear arrangement thereby preventing rotation of the roller 26 in the counter-clockwise direction, as indicated, by moving the end 37A of the post 37 towards the end of the hollow channel 26B. Although the operative arrangement between the spring clip 34 and the directional rotation of the roller 26 and drive wheel 32 is depicted herein, the spring clip 33, roller 19 and drive knob 25 shown earlier in FIG. 3 operate in a similar manner to control the directional rotation of the associated roller 19.

Figure 5:
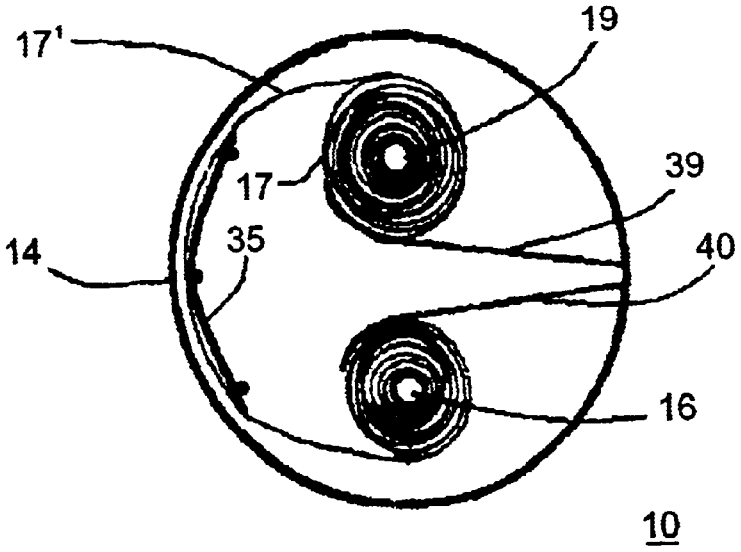
FIG. 5 is an enlarged end view of the reader roller of FIG. 1 with one end of the outer cylinder removed to depict the travel of the paper scroll between the two rollers.

FIG. 5 depicts the reader roller 10 of FIGS. 1–3 with the sidepieces 12, 13 and gear drive arrangement removed to show the transfer of the paper 17' on the scroll 17 from the first roller 19 to the second roller 26. A paper guide 38 is positioned next to the viewing window 14 to maintain the paper in proximity with the viewing window for greater visual access. A pair of spring guides 39,40 are arranged intermediate the rollers 19,26 to maintain tension between the paper 17' and rollers 19, 26 in transit.

A reader roller has herein been described for ease in reading material in a sitting position, in the absence of a desk or table support.

What is claimed is:

1. A roller reader comprising:

a hollow cylinder enclosure including a first sidepiece at one end and a second side piece at an opposite end thereof and a viewing slot formed in said cylinder intermediate said first and second sidepieces;

a first driver knob attached to a first gear driver operatively attached to said first sidepiece and a second driver knob attached to a second gear driver operatively attached to said second sidepiece;

a first roller having first gear teeth at one end, within said cylinder proximate said first gear driver for rotating said first roller in a first direction and a second roller having first gear teeth at one end, within said cylinder proximate said first gear driver for rotating said second roller in a second direction opposite said first direction, and a paper scroll having paper thereon containing printed material, said paper scroll being arranged on one of said first or second rollers, whereby rotation of said first or second driver knobs causes said paper to transfer between said first and second rollers.

2. The roller reader of claim 1 wherein said first gear teeth are arranged for transfer in first direction via said first gear driver and said second gear teeth are arranged for transfer in a second direction via said second gear teeth, said second direction being opposite said first direction.

3. The roller reader of claim 1 including a first inner plate intermediate said first sidepiece and said one end of said cylinder and a second inner plate intermediate said second sidepiece and said opposite end of said cylinder.

4. The roller reader of claim 3 wherein said first inner plate includes a first inner plate aperture for supporting said first gear driver and a second inner plate aperture for supporting an end of said second roller.

5. The roller reader of claim 3 wherein said second inner plate includes a second inner plate first aperture for supporting said second gear driver and a second plate second aperture for supporting an end of said first roller.

6. The roller reader of claim 3 including a first spring clip intermediate said first sidepiece and said first gear driver for holding said first gear driver in abutment with said first gear teeth when said first driver knob is rotated in a clockwise direction and for holding said first gear driver out of abutment with said first gear teeth when said first gear knob is rotated in a counter-clockwise direction.

7. The roller reader of claim 3 including a second spring clip intermediate said second sidepiece and said second gear driver for holding said second gear driver in abutment with said second gear teeth when said second driver knob is rotated in a clockwise direction and for holding said second gear driver out of abutment with said second gear teeth when said second gear knob is rotated in a counter-clockwise direction.

8. The roller reader of claim 1 including a plastic lens within said viewing slot.

9. The roller reader of claim 8 including a paper guide within said cylinder, intermediate said lens and said first and second rollers for holding said paper proximate said lens when said paper transfers between said first and second rollers.

10. The roller reader of claim 1 including a first tension spring proximate said first roller for holding said paper onto said first roller and a second tension spring proximate said second roller for holding said paper onto said second roller.

11. The roller reader of claim 1 including means for suspending said cylinder in the horizontal plane.

12. The roller reader of claim 11 wherein said means for suspending said cylinder comprises a strap.

13. The roller reader of claim 11 wherein said means for suspending said cylinder comprises a holder, said holder including a first arm having a first arm first hook at one end arranged for engaging a toilet paper support rod and a first arm second hook at an opposite end arranged for engaging said cylinder, and a second arm proximate said first arm, said second arm having a second arm first hook at one end arranged for engaging a toilet paper support rod and a second arm second hook at an opposite end arranged for engaging said cylinder.

14. The roller reader of claim 13 wherein said first arm first hook is 180 degrees disposed from said first arm second hook.

15. The roller reader of claim 13 wherein said second arm first hook is 180 degrees disposed from said second arm second hook.

16. The roller reader of claim 13 wherein said first arm first hook is smaller than said first arm second hook.

17. The roller reader of claim 13 wherein said second arm first hook is smaller than said second arm second hook.

18. The roller reader of claim 13 including a support brace extending between said first and second arms.

* * * * *